US005547799A

United States Patent [19]

Yoshie et al.

[11] Patent Number: 5,547,799

[45] Date of Patent: Aug. 20, 1996

[54] ELECTROPHOTOGRAPHIC TONER WITH FISCHER-TROPSCH WAX HAVING MEAN MOLECULAR WEIGHT OF NOT LESS THAN 1,000

[75] Inventors: Naoki Yoshie, Takatsuki; Junji Machida, Toyonaka, both of Japan

[73] Assignee: Minolta Co., Ltd., Osaka, Japan

[21] Appl. No.: 421,937

[22] Filed: Apr. 14, 1995

[30] Foreign Application Priority Data

Apr. 15, 1994 [JP] Japan ..... 6-077232

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 4,367,276 | 1/1983 | Cooper | 430/102 X |
| 4,882,258 | 11/1989 | Ikeuchi et al. | 430/110 X |
| 4,943,506 | 7/1990 | Demizu et al. | 430/110 X |
| 5,004,666 | 4/1991 | Tomono et al. | 430/110 |
| 5,124,222 | 6/1992 | Clark et al. | 430/106.6 |
| 5,296,266 | 3/1994 | Kunugi et al. | 430/138 X |
| 5,368,972 | 11/1994 | Yamashita et al. | 430/110 X |

FOREIGN PATENT DOCUMENTS

| | | |
|---|---|---|
| 61-273554 | 12/1986 | Japan . |
| 61-273555 | 12/1986 | Japan . |
| 4-153659 | 5/1992 | Japan . |

*Primary Examiner*—Roland Martin

*Attorney, Agent, or Firm*—Burns, Doane, Swecker & Mathis, L.L.P.

[57] ABSTRACT

The present invention relates to a toner for electrophotography comprising:

(a) a styrene-acrylic polymer resin;

(b) a colorant; and (c) a Fischer-Tropsch wax having average molecular weight not less than 1,000.

31 Claims, No Drawings

ELECTROPHOTOGRAPHIC TONER WITH FISCHER-TROPSCH WAX HAVING MEAN MOLECULAR WEIGHT OF NOT LESS THAN 1,000

BACKGROUND OF THE INVENTION

1. Field of the Invention

The present invention relates to electrophotographic toners for use with electrophotographic image-forming apparatus, such as copying machines and printers.

2. Description of the Prior Art

For an electrophotographic toner fixed by heating on paper, styrene-acrylic resins have been widely used which are produced by copolymerizing a styrene monomer, such as styrene, with an acrylic monomer, such as methyl acrylate.

However, since styrene-acrylic resins generally have low toughness, a toner comprised of such resin is liable to a trouble such that when a load is applied on stacked papers having a toner image fixed thereon so that friction was caused to the papers, some toner stain is caused to the back of an upper-side paper, or a so-called smear trouble.

The occurrence of such smear poses a problem in the case of, for example, double-side copying that is recently widely in practice for the purpose of resource saving, because it causes a stain to an image surface. Therefore, a need exists for an electrophotographic toner which is free from smear trouble, that is, a toner having good smear resistance.

SUMMARY OF THE INVENTION

It is an object of the present invention to provide an electrophotographic toner excellent in smear resistance.

It is another object of the present invention to provide an electrophotographic toner excellent in heat resistance.

It is further object of the present invention to provide an electrophotographic toner showing a wide non-off-set region.

DETAILED DESCRIPTION OF THE PRESENT INVENTION

The present invention is characterized in that a resin composed principally of a styrene-acrylic copolymer is used as a binder resin, and in that the toner contains a Fischer-Tropsch wax having a mean molecular weight of 1,000 or more.

Styrene monomers useful as a styrene component of the styrene-acrylic copolymer in the binder resin include, for example, styrene and styrene derivatives, such as m-methylstyrene, p-methylstyrene, 2, 4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3, 4-dichlorostyrene. Inter alia, styrene is most preferred.

Acrylic monomers useful as an acrylic component of the styrene-acrylic copolymer include, for example, acrylic acids and their derivatives, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, and α-methyl chloroacrylate; methacrylic acid and their derivatives, such as methyl methacrylate, ethyl methacrylate, propyl methacrylate, n-butyl methacrylate, isobutyl methacrylate, propyl methacrylate, n-octyl methacrylate, dodecyl methacrylate, 2-ethylhexyl methacrylate, stearyl methacrylate, phenyl methacrylate, and dimethylaminoethyl methacrylate; and acrylic derivatives, such as acrylonitrile, methacrylonitrile, and acrylic amide. Inter alia, n-butyl acrylate and methyl methacrylate are most preferred.

Colorants contained in the toner of the present invention include organic and inorganic pigments and dyes in various colors as enumerated below.

Black colorants include carbon black, copper oxide, manganese dioxide, aniline black, activated charcoal, non-magnetic ferrite, and magnetite.

Yellow colorants include yellow lead, zinc yellow, cadmium yellow, mineral fast yellow, nickel titanium yellow, nables yellow, naphthol yellow S, Hansa yellow G, Hansa yellow 10G, benzidine yellow G, benzidine yellow GR, quinoline yellow lake, permanent yellow NCG, and Tartrazine lake.

Red colorants include iron oxide red, cadmium red, red lead, mercury sulfide, cadmium, permanent red 4R, lithol red, pyrazolone red, Watchung red, calcium salt, lake red C, lake red D, brilliant carmine 6B, eosine lake, rhodamine lake B, alizarin lake, and brilliant carmine 3B.

Blue colorants include Prussian blue, cobalt blue, alkali blue lake, victoria blue lake, phthalocyanine blue, metal-free phthalocyanine blue, partially chlorinated phthalocyanine blue, fast sky blue, and indanthrene blue BC.

These colorants may be used alone or in combination and in a range of 1 to 20 parts by weight, preferably 2 to 10 parts by weight, on the basis of 100 parts by weight of binder resin. If the amount of colorant is greater than 20 parts by weight, the fixing performance of the toner will be lowered. If the amount of colorant is smaller than 1 part by weight, any desired image density cannot be obtained.

Various types of Fischer-Tropsch wax known in the art may be used for the purpose of the invention insofar as they have a molecular weight of 1,000 or more, preferably 1,200–2,000. For example, Sasol C2 (solidifying point: 104°–110° C.; mean molecular weight: 1262; average molecular formula: $C_{90}H_{182}$), Sasol C105 (solidifying point: 104°–110° C.; mean molecular weight: 1,300), and SPRAY 105 (fine-powder type of Sasol 105), which are products of Sasol Chemical Industries, may be enumerated. Preferable Fischer-Tropsch wax has a solidification point of 100° C. or more. If the solidification point is less than 100° C., heat resistance may not be achieved satisfactorily.

Preferably, the loading of Fischer-Tropsch wax is 1 to 10 parts by weight, preferably 2 to 5 parts by weight, relative to 100 parts by weight of the binder resin component of the toner. If the loading is smaller than 1 part by weight, the smear-proof performance of the wax is unfavorably reduced. If the loading exceeds 10 parts by weight, there will arise problems, such as defective cleaning and material-filming on photoconductor.

The Fischer-Tropsch wax may be blended with a polyolefin wax, such as a low molecular-weight polyethylene wax or a low molecular-weight polypropylene wax. By blending in a polyolefin wax is it possible to broaden the offset-free range of fixing-temperatures by 10° to 20° C. In this case, the total loading of Fischer-Tropsch wax and polyolefin wax is preferably 2 to 10 parts by weight relative to 100 parts by weight of the binder resin component of the toner, and it is preferable that 50 to 200 wt % of polyolefin wax is used relative to the weight of Fischer-Tropsch wax. If the Fischer-Tropsch wax is contained at an amount of 0.5 percent by weight or less, smear-resistance may not be achieved satisfactorily.

The toner may be loaded with a charge controlling agent or a charge controlling resin.

Positive charge controlling agents useful for this purpose include, for example, Nigrosine base EX (azine compound), Bontoron N-01, 02, 04, 05, 07, 09, 10, 13 (made by Orient Kagaku Kogyo K.K.); oil black (made by Chuo Gosei Kagaku K.K.); quaternary ammonium salt P-51, polyamine compound P-52, Sudan Chief Schwaltz BB (solvent black 3; C.I.No. 26150), Fett Schwaltz HBN (C.I.No. 26150), brilliant spirit Schwaltz TN (made by Farbenfabriken Bayer K.K.); and alkoxylated amine, alkyl amide, chelate molybdate, and imidazole compounds.

Useful negative charge controlling agents include, for example, chrome complex-salt type azo dyes S-32, 33, 34, 35, 37, 38, 40 (made by Orient Kagaku Kogyo K.K.), Aizen Spilon Black TRH, BHH (made by Hodogaya Kagaku K.K.), Kayaset Black T-22,004 (made by Nihon Kayaku K.K.), copper phthalocyanine dye S-39 (made by Orient Kagaku Kogyo K.K.), chrome complex salt E-81, 82 (made by Orient Kagaku Kogyo K.K.), zinc complex salt E-84 (made by Orient Kagaku Kogyo K.K.), aluminum complex salt E-86 (made by Orient Kagaku Kogyo K.K.), and carix allene compounds. Of above enumerated charge controlling agents, those of a larger particle size should preferably be adjusted to a desired particle size by pulverizing before they are put in use.

For the charge controlling resin, nitrogen-containing polymers and terpene compounds may be exemplified.

Any of these charge controlling agents or charge controlling resins may be added in an amount of not more than 8 parts by weight, preferably not more than 5 parts by weight, relative to 100 parts by weight of the binder resin component of the toner. If the amount of such addition is greater than 8 parts by weight, an electrical charge amount of toner is so high that the desired density cannot be obtained.

The toner of the invention may be externally added with a fluidizing agent (after-treatment agent). The addition of fluidizing agent effects to restrain aggregation of toner in a high-temperature environment. Examples of externally addable fluidizing agents include silica, aluminum oxide, titanium oxide, silica-aluminum oxide mixtures, and silica-titanium oxide mixtures. In particular, those which are rendered hydrophobic are preferred.

The loading of fluidizing agent is preferably not more than 2 parts by weight relative to 100 parts by weight of binder resin.

Any conventional process for preparation of toner particles may be employed without particular limitation. For example, pulverizing processes, granulation processes, such as emulsion polymerization and suspension polymerization, wet granulation processes, such as emulsion dispersion granulation and spray drying, and microcapsulation process may be equally employed.

Toner particles have a particle size of 3 to 20 μm, preferably 4 to 15 μm. If the particle size is smaller than 3 μm, the toner is adversely affected in its charge holding ability and fluidity. If the particle size is larger than 20 μm, any high quality image cannot be obtained.

The toner described above may be used not only as a single-component developer, but also as a two-component developer. When used as the two-component developer, the toner may be used with any of various types of carriers known in the art.

EXAMPLES

The present invention will be described in more detail with reference to various examples and comparative examples given hereinbelow.

Example of the Production of Polymer a

Into a circular pipe separable flask, equipped with a condenser, an agitator, a gas inlet pipe, and a thermometer, was introduced 3,000 g of xylene, which was then heated and refluxed. A mixture of 210 parts by weight of styrene, 90 parts by weight of n-butyl acrylate, and 5 parts by weight of a polymerization initiator (V-59, made by Wako Junyaku K.K.) was added dropwise in about 30 minutes. After completion of the dropwise addition, the resulting mixture was refluxed for 2 hours to complete polymerization. Thus Polymer a was obtained.

Polymer a was examined by gel permeation chromatography (GPC) for molecular weight measurement to give a number-mean molecular weight (Mn) of 16,000 and a weight-mean molecular weight (Mw) of 252,000, and a glass transition point (Tg) of 64° C.

Example of the Production of Polymer b

Polymer b was prepared with a mixture of 195 parts by weight of styrene, 105 parts by weight of n-butyl methacrylate, and 5 parts by weight of a polymerization initiator (V-59, made by Wako Junyaku K.K.) in a manner similar to Example of the Production of Polymer a. Polymer b exhibited GPC molecular weights of Mn=14,000 and Mw=238,000, and had a Tg of 62° C.

Example of the Production of Polymer c

Polymer c was prepared with a mixture of 195 parts by weight of styrene, 90 parts by weight of n-butyl methacrylate, 15 parts by weight of methyl methacrylate, and 5 parts by weight of a polymerization initiator (V-59, made by Wako Junyaku K.K.) in a manner similar to Example of the Production of Polymer a. Polymer c exhibited GPC molecular weights of Fin=15,000 and Mw=260,000, and had a Tg of 63° C.

Example of the Production of Polymer d

Polymer d was prepared with a mixture of 210 parts by weight of styrene, 90 parts by weight of n-butyl acrylate, and 5 parts by weight of a polymerization initiator (V-59, made by Wako Junyaku K.K.) in a manner similar to Example of the Production of Polymer a. Polymer d exhibited GPC molecular weights of Mn=20,000 and Mw=263,000, and had a Tg of 66° C.

Example of the Production of Toner A

The following materials were thoroughly mixed in a ball mill, and were then thoroughly mixed on three rolls heated to 140° C.

| | |
|---|---|
| Polymer a | 100 wt parts; |
| Carbon black (Elftex 8; made by Cabot K.K.) | 10 wt parts; |
| Fischer Tropsch wax | 5 wt parts |

(Sasol C2, mean molecular weight 1262, made by Sasol Chemical Industries)

After being allowed to cool, the mixture was roughly pulverized by using a Feather mill and then pulverized finely by a jet mill. Subsequently, air classification was carried out to give fine particles having a mean particle size of 11 μm. One hundred parts by weight of the fine particles and 0.4 parts by weight of hydrophobic titanium oxide fine particles (OK-18, made by Teika K.K.) were mixed together in a Henschel mixer. Thus Toner A was obtained.

Example of the Production of Toner B

By the use of the following materials and according to the same procedure as Example of the Production of Toner A was obtained fine particles having a mean particle size of 11 μm.

| | |
|---|---|
| Polymer b | 100 wt parts; |
| Carbon black (Regal 330R; made by Cabot K.K.) | 10 wt parts; |
| Fischer Tropsch wax (Sasol C2, mean molecular weight 1262, made by Sasol Chemical Industries) | 4 wt parts |
| Polypropylene wax (Viscol 550P, made by Sanyo K.K.) | 1 wt part |
| Nitrogen-containing resin (Lunabel 912, made by Arakawa kagaku K.K.) | 3 wt parts. |

One hundred parts by weight of the fine particles and 0.4 parts by weight of hydrophobic titanium oxide fine particles (OK-18, made by Teika K.K.) were mixed together in a Henschel mixer. Thus Toner B was obtained.

Example of the Production of Toner C

By the use of the following materials and according to the same procedure as Example of the Production of Toner A was obtained fine particles having a mean particle size of 11 μm.

| | |
|---|---|
| Polymer c | 100 wt parts; |
| Carbon black (Regal 330R; made by Cabot K.K.) | 10 wt parts; |
| Fischer Tropsch wax (Sasol C105, mean molecular weight 1300, made by Sasol Chemical Industries) | 3 wt parts |
| Polypropylene wax (Viscol 550P, made by Sanyo Kasei K.K.) | 2 wt parts |
| Nitrogen-containing resin (Lunabel 912, made by Arakawa kagaku K.K.) | 3 wt parts. |

One hundred parts by weight of the fine particles and 0.8 parts by weight of hydrophobic titanium oxide fine particles (MT-600BS, made by Teika K.K.) were mixed together in a Henschel mixer. Thus Toner C was obtained.

Example of the Production of Toner D

By the use of the following materials and according to the same procedure as Example of the Production of Toner A was obtained fine particles having a mean particle size of 11 μm.

| | |
|---|---|
| Polymer d | 100 wt parts; |
| Carbon black (Mogul L; made by Cabot K.K.) | 8 wt parts; |
| Fischer Tropsch wax (Sasol C105, mean molecular weight 1300, made by Sasol Chemical Industries) | 3 wt parts |
| Polypropylene wax (Viscol 605P, made by Sanyo Kasei K.K.) | 3 wt parts |
| Nigrosine (NB-EX, made by Orient kagaku K.K.) | 4 wt parts. |

One hundred parts by weight of the fine particles and 0.8 parts by weight of hydrophobic titanium oxide fine particles (OK-18, made by Teika K.K.) were mixed together in a Henschel mixer. Thus Toner D was obtained.

Example of the Production of Toner E

By the use of the following materials and according to the same procedure as Example of the Production of Toner A was obtained fine particles having a mean particle size of 11 μm.

| | |
|---|---|
| Polymer d | 100 wt parts; |
| Carbon black (Raven 1250, made by Colombia Carbon K.K.) | 10 wt parts; |
| Fischer Tropsch wax (SPRAY 105, mean molecular weight 1300, made by Sasol Chemical Industries) | 2.5 wt parts |
| Polypropylene wax (Viscol 605P, made by Sanyo Kasei K.K.) | 2.5 wt parts |
| Quaternary ammonium salt (P-51, made by Orient kagaku K.K.) | 5 wt parts. |

One hundred parts by weight of the fine particles and 0.4 parts by weight of hydrophobic alumina particles (RFY-C, made by Nihon Aerosil K.K.) were mixed together in a Henschel mixer. Thus Toner E was obtained.

Example of the Production of Toner F

By the use of the following materials and according to the same procedure as Example of the Production of Toner A was obtained fine particles having a mean particle size of 11 μm.

| | |
|---|---|
| Polymer d | 100 wt parts; |
| Carbon black (Mogul L; made by Cabot K.K.) | 10 wt parts; |
| Fischer Tropsch wax (Sasol C105, mean molecular weight 1300, made by Sasol Chemical Industries) | 3 wt parts |
| Polypropylene wax (Viscol 605P, made by Sanyo Kasei K.K.) | 3 wt parts |
| Chrome complex-salt type azo dye (S-34, made by Orient kagaku K.K.) | 3 wt parts. |

One hundred parts by weight of the fine particles and 0.2 parts by weight of hydrophobic silica particles (H-2000/4, made by Nihon Aerosil K.K.) were mixed together in a Henschel mixer. Thus Toner F was obtained.

Example of the Production of Toner G

By the use of the following materials and according to the same procedure as Example of the Production of Toner A was obtained fine particles having a mean particle size of 11 μm.

| | |
|---|---|
| Polymer a | 100 wt parts; |
| Carbon black (Regal 330R; made by Cabot (K.K.) | 10 wt parts; |
| Fischer Tropsch wax (Sasol C105, mean molecular weight 1300, made by Sasol Chemical Industries) | 5 wt parts |
| Nitrogen-containing resin (Lunabel 912, made by Arakawa kagaku K.K.) | 3 wt parts. |

One hundred parts by weight of The fine particles and 0.4 parts by weight of hydrophobic titanium oxide fine particles (OK-18, made by Teika K.K.) were mixed together in a Henschel mixer. Thus Toner G was obtained.

Example of the Production of Toner H

By the use of the following materials and according to the same procedure as Example of the Production of Toner A was obtained fine particles having a mean particle size of 11 μm.

| | |
|---|---|
| Polymer b | 100 wt parts; |
| Carbon black (Regal 330R, made by Cabot K.K.) | 10 wt parts; |
| Fischer Tropsch wax (Sasol C2, mean molecular weight 1262, made by Sasol Chemical Industries) | 2 wt parts |
| Polypropylene wax (Viscol 550P, made by Sanyo Kasei K.K.) | 2.5 wt parts |
| Quaternary ammonium salt (P-51, made by Orient kagaku K.K.) | 5 wt parts. |

One hundred parts by weight of the fine particles and 0.4 parts by weight of hydrophobic alumina particles (RFY-C, made by Nihon Aerosil K.K.) were mixed together in a Henschel mixer. Thus Toner H was obtained.

Example of the Production of Toner I

By the use of the following materials and according to the same procedure as Example of the Production of Toner A was obtained fine particles having a mean particle size of 11 μm.

| | |
|---|---|
| Polymer a | 100 wt parts; |
| Carbon black (Regal 330R, made by Cabot K.K.) | 10 wt parts; |
| Polypropylene wax (Viscol 550P, made by Sanyo Kasei K.K.) | 3 wt parts |
| Quaternary ammonium salt (P-51, made by Orient kagaku K.K.) | 2 wt parts. |

One hundred parts by weight of the fine particles and 0.4 parts by weight of hydrophobic titanium oxide fine particles (OK-18, made by Teika K.K.) were mixed together in a Henschel mixer. Thus Toner I was obtained.

Example of the Production of Toner J

By the use of the following materials and according to the same procedure as Example of the Production of Toner A was obtained fine particles having a mean particle size of 11 μm.

| | |
|---|---|
| Polymer b | 100 wt parts; |
| Carbon black (Regal 330R; made by Cabot K.K.) | 10 wt parts; |
| Fischer Tropsch wax (Sasol H1, solidifying point 98° C., mean molecular weight 814, made by Sasol Chemical Industries) | 4 wt parts |
| Nitrogen-containing resin (Lunabel 912, made by Arakawa kagaku K.K.) | 3 wt parts. |

One hundred parts by weight of the fine particles and 0.4 parts by weight of hydrophobic titanium oxide fine particles (OK-18, made by Teika K.K.) were mixed together in a Henschel mixer. Thus Toner J was obtained.

Example of the Production of Toner K

By the use of the following materials and according to the same procedure as Example of the Production of Toner A was obtained fine particles having a mean particle size of 11 μm.

| | |
|---|---|
| Polymer a | 100 wt parts; |
| Carbon black (Printex L, made by Degussa K.K.) | 10 wt parts; |
| Fischer Tropsch wax (Sasol C1, solidifying point 90° C., mean molecular weight 794, made by Sasol Chemical Industries) | 5 wt parts |
| Nitrogen-containing resin (Lunabel 912, made by Arakawa kagaku K.K.) | 3 wt parts. |

One hundred parts by weight of the fine particles and 0.4 parts by weight of hydrophobic titanium oxide fine particles (OK-18, made by Teika K.K.) were mixed together in a Henschel mixer. Thus Toner K was obtained.

Example of the Production of Toner L

By the use of the following materials and according to the same procedure as Example of the Production of Toner A was obtained fine particles having a mean particle size of 11 μm.

| | |
|---|---|
| Polymer d | 100 wt parts; |
| Carbon black (Mogul L; made by Cabot K.K.) | 8 wt parts; |
| Fischer Tropsch wax (Sasol H1, mean molecular weight 814, made by Sasol Chemical Industries) | 2.5 wt parts |
| Polypropylene wax (Viscol 550P, made by Sanyo Kasei K.K.) | 2.5 wt parts |
| Nigrosine (NB-EX, made by Orient kagaku K.K.) | 4 wt parts. |

One hundred parts by weight of the fine particles and 0.8 parts by weight of hydrophobic titanium oxide fine particles (MT-600BS, made by Teika K.K.) were mixed together in a Henschel mixer. Toner L was obtained.

Example of the Production of Toner M

By the use of the following materials and according to the same procedure as Example of the Production of Toner A was obtained fine particles having a mean particle size of 11 μm.

| | |
|---|---|
| Polymer d | 100 wt parts; |
| Carbon black (Mogul L; made by Cabot K.K.) | 8 wt parts; |
| Nigrosine (NB-EX, made by Orient kagaku K.K.) | 4 wt parts. |

One hundred parts by weight of the fine particles and 0.8 parts by weight of hydrophobic titanium oxide fine particles (OK-18, made by Teika K.K.) were mixed together in a Henschel mixer. Thus Toner M was obtained.

With respect to the foregoing Examples of the Production, types of binder resins, types of waxes, and types of charge controlling agents used therein are listed in Table 1.

TABLE 1

| | Resin | Wax | CCA | Fluidizing Agent (pbw) |
|---|---|---|---|---|
| Toner Production Ex. 1 (Toner A) | Polymer a St-BA (70:30) | C2 Fischer-Tropsch wax 5 | None | Titanium oxide (0.4) |
| Toner Production Ex. 2 (Toner B) | Polymer b St-BMA (65:35) | C2 Fischer-Tropsch wax 4 Polypropylene wax 1 | Nitrogen-containing resin | Titanium oxide (0.4) |
| Toner Production Ex. 3 (Toner C) | Polymer c St-BMA-MMA (65:30:5) | C105 Fischer-Tropsch wax 3 Polypropylene wax 2 | Nitrogen-containing resin | Titanium oxide (0.8) |
| Toner Production Ex. 4 (Toner D) | Polymer d St-BA (70:30) | C105 Fischer-Tropsch wax 3 Polypropylene wax 3 | Nigrosine | Titanium oxide (0.8) |
| Toner Production Ex. 5 (Toner E) | Polymer d St-BA (70:30) | SPRAY105 Fischer-Tropsch wax 2.5 Polypropylene wax 2.5 | Quaternary ammonium salt | Alumina (0.4) |
| Toner Production Ex. 6 (Toner F) | Polymer d St-BA (70:30) | C105 Fischer-Tropsch wax 3 Polypropylene wax 2 | Chrome acid type azo dye | Silica (0.2) |
| Toner Production Ex. 7 (Toner G) | Polymer a St-BA (70:30) | C105 Fischer-Tropsch wax 5 | Nitrogen-containing resin | Titanium oxide (0.4) |
| Toner Production Ex. 8 (Toner H) | Polymer b St-BMA (65:35) | C2 Fischer-Tropsch wax 2 Polypropylene wax 2.5 | Quaternary ammonium salt | Alumina (0.4) |
| Toner Production Ex. 9 (Toner I) | Polymer a St-BA (70:30) | Polypropylene wax 3 | Quaternary ammonium salt | Titanium oxide (0.4) |
| Toner Production Ex. 10 (Toner J) | Polymer b St-BMA (65:35) | H1 Fischer-Tropsch wax 4 | Nitrogen-containing resin | Titanium oxide (0.4) |
| Toner Production Ex. 11 (Toner K) | Polymer a St-BA (70:30) | C1 Fischer-Tropsch wax 5 | Nitrogen-containing resin | Titanium oxide (0.4) |
| Toner Production Ex. 12 (Toner L) | Polymer d St-BA (70:30) | H1 Fischer-Tropsch wax 2.5 Polypropylene wax 2.5 | Nigrosine | Titanium oxide (0.8) |
| Toner Production Ex. 13 (Toner M) | Polymer d St-BA (70:30) | No wax | Nigrosine | Titanium oxide (0.8) |

Example of the Production of Carrier I

Into an argon-displaced flask with an internal area of 500 ml were introduced 200 ml of dehydrated n-heptane and 15 g (25 millimole) of a magnesium stearate which had been dehydrated under reduced pressure (2 mmHg) at 120° C., and the content was slurried at room temperature. Titanium tetrachloride, 0.44 g (2.3 millimole), was added dropwise with stirring. After the dropwise addition, a temperature rise was initiated and the contents were caused to react for one hour under reflux, with the result that a viscous transparent solution of a titanium-containing catalyst component was obtained.

Then, 500 ml of dehydrated hexane and 450 g of a sintered ferrite powder which had been dried for 3 hours at 200° C. under reduced pressure (2 mmHg) were introduced into an argon-displaced autoclave having an internal volume of 1 liter, and stirring was initiated at room temperature. Then, the temperature was increased to 40° C. and 0.02 millimole of the titanium-containing catalyst component solution in terms of titanium atoms was added, with reaction allowed for one hour. Subsequently, 0.47 g of carbon black (Ketchen Black DJ-600, made by Lion Akuzo K.K.) was introduced into the autoclave through a nozzle at the top thereof. It is noted in this connection that the carbon black used was such that it had been dried at 200° C. for one hour under reduced pressure and slurried with dehydrated hexane.

Further, 2.0 millimole of triethyl aluminum and 2.0 millimole of diethyl aluminum chloride were added and the temperature was increased to 90° C. At this point of time, the internal pressure was 1.5 kg/cm$^2$ G. Then, hydrogen was supplied to increase the pressure to 2 kg/cm$^2$ G and thereafter polymerization was carried out for 45 minutes while ethylene was supplied so as to allow the entire pressure to be kept at 6 kg/cm$^2$ G. As a result, a polyethylene composition containing ferrite and carbon black was obtained in a total amount of 469.3 g.

A powder mass obtained by drying the composition was found to be uniformly black in color. An electron microscopic observation showed that the ferrite surface was lightly covered with polyethylene, with carbon black dispersed uniformly in the polyethylene. A thermogravimetric analysis showed that the composition had a core bulk density of 95.5 wt %. The weight ratio of ferrite:polyethylene:carbon black, as calculated from the charge weight of the ingredients, was 24:1:0.025.

Subsequently, the composition was placed in a hot air stream set to 120° C. for heat treatment for 2 hours, and then the composition was classified by means of a 106 μm screen for removal of agglomerates. As a result, Carrier I was obtained which had an electrical resistance of $3.5\times10^8\Omega\cdot$cm.

The electrical resistance of the carrier was determined in the following manner. A sample was placed on a metal-made circular electrode to have a thickness of 1 mm and a diameter of 50 mm, and placed on the sample were an electrode having a weight of 895.4 g and a diameter of 20 mm and a guarded electrode having an inner diameter of 38 mm and an outer diameter of 42 mm. A 500 V DC voltage was applied. The current value after one minute voltage application was read, and the reading was converted into volume resistivity ρ of the sample. Environmental conditions for the measurement were: temperature of 25°±1° C., and relative humidity of 55±5%. Measurement was repeated 5 times, and a mean value of the measurements was taken as a measured value.

Example of the Product of Carrier II

A polyethylene composition containing ferrite and carbon black was obtained in a total amount of 469.3 g in the same way as in the foregoing Example of the Product of Carrier I, except that, for the carbon black component, 1.50 g of DB #2350, made by Mitsubishi Kasei K.K. was used.

A powder mass obtained by drying the composition was found to be uniformly black in color. An electron microscopic observation showed that the ferrite surface was lightly covered with polyethylene, with carbon black dispersed uniformly in the polyethylene. A thermogravimetric analysis showed that the composition had a core bulk density of 95.5 wt %. The weight ratio of ferrite:polyethylene:carbon black, as calculated from the charge weight of the ingredients, was 24:1:0.008.

Subsequently, the composition was placed in a hot air stream set to 120° C. for heat treatment for 2 hours, and then the composition was classified by means of a 106 μm screen for removal of agglomerates. As a result, carrier II was obtained which had an electrical resistance of $5.0\times10^{8}\Omega\cdot$cm.

Example of the Product of Carrier III

A thermosetting silicone resin solution (KR- 255, made by Shinetsu Silicone K.K.) was applied to sintered ferrite particles (F-300, made by Powdertech K.K.) by using SPIRA COTA SP-40 (made by Okada Seiko K.K.). In this case, spray coating was carried out under the conditions of spray pressure: 3.5 kg/cm, spray rate: 40 g/min, temperature: 50° C., with coating repeated to provide a coating of 1.0 wt % on ferrite particles.

Next, the room temperature was increased to 150° C. for setting the resin. A 106 μm screen was used to eliminate agglomerates. Thus, coated carrier III was obtained which had a mean particle size of 55 μm and an electrical resistance of $7.5\times10^{8}\Omega\cdot$cm.

Example of the Product of Carrier IV

One hundred parts by weight of polyester resin (Mn=5000, Mw=115000, Tg=67° C., softening point=123 ° C.), 500 parts by weight of fine ferrite particles (MFP-2, made by TDK K.K.), and 3 parts by weight of colloidal silica dispersant (Aerosil #200, made by Nihon Aerosil) were thoroughly mixed in a Henschel mixer, and then the mixture was melt and kneaded in a double-screw extruder/kneader. The kneaded material was cooled and pulverized coarsely and further finely pulverized in a jet mill. The obtained particles were then classified by an air classifier. As a result, a dispersion-type carrier IV was obtained which had a mean particle size of 60 μm and an electrical resistance of $5.8\times10^{13}\Omega\cdot$cm.

EXAMPLES 1–8

Toners A–H and Carriers I–IV were mixed to prepare developers for evaluation. Toner was mixed with Carrier in a combination as shown in Table 2 at a mixing ratio of Toner:Carrier of 5:95 by weight.

COMPARATIVE EXAMPLES 1–5

Toners I–M and Carriers I and IV were mixed in a combination as shown in Table 2 to prepare developers for evaluation in a manner similar to EXAMPLES 1–8.

Respective developers were evaluated with respect to their smear resistance, heat resistance, and fixing-temperature region free from offset occurrence (non-offset region).

Method of Smear Evaluation

Using a commercial electrophotographic copying machine EP-410Z (made by Minolta Co., Ltd.), with the exception of Example 6 in which a commercial electrophotographic copying machine EP-550Z (made by Minolta Co., Ltd.) was used, solid images were fixed on a copying paper (EP paper, made by Minolta Co., Ltd.). On the fixed images were placed a copying paper, with a 200 g weight placed on the copying paper, and a motor was driven to rotate the weight one turn. Judgement as to smear occurrence was made from the degree of stain with the copying paper placed on the fixed image. Specifically, ID value was determined by a densitometer, and smear resistance evaluation was made to be ranked as follows.

◎: ID<0.05

O: 0.05<ID<0.1

X: ID>0.1

Where the evaluation is ◎ or O, there is no problem for practical use.

Heat Resistance Evaluation

Five grams of Toner was placed in a 50 cc glass bottle, and the same was stored for 10 hours under ambient conditions of 60° C. After that, the degree of toner agglomeration was visually evaluated to be ranked as follows.

O: no agglomerate, no change from pre-storage condition.

X: agglomeration caused all over.

Measurement of Non-Offset Region

Using a commercial electrophotographic copying machine EP-410Z (made by Minolta Co., Ltd.), with the exception of Example 6 in which a commercial electrophotographic copying machine EP-550Z (made by Minolta Co., Ltd.) was used, solid images were developed, which were fixed on a copying paper (EP paper, made by Minolta Co., Ltd.) by using a fixing unit of a hot-roll type under different temperature conditions. In this case, presence or absence of offset on the fixing roller was visually observed to determine offset region.

The results of actual photocopying tests made using the developer of respective examples and comparative examples are summarized in Table 2. The developer of Comparative Example 5 was found to be very much liable to offset trouble and therefore its low-temperature fixing characteristics could not be determined.

TABLE 2

| | Toner | Carrier | Smear | Heat resistance | Non-offset region |
|---|---|---|---|---|---|
| Ex. 1 | A | II | ◎ | o | 140–230 |
| Ex. 2 | B | I | ◎ | o | 135–235 |
| Ex. 3 | C | I | ◎ | o | 130–240 |
| Ex. 4 | D | IV | ◎ | o | 130–240 |
| Ex. 5 | E | III | o | o | 130–240 |
| Ex. 6 | F | I | ◎ | o | 130–240 |
| Ex. 7 | G | I | ◎ | o | 140–230 |
| Ex. 8 | H | I | o | o | 130–240 |
| Comp. Ex. 1 | I | I | x | o | 130–240 |
| Comp. Ex. 2 | J | I | ◎ | x | 140–230 |
| Comp. Ex. 3 | K | I | ◎ | x | 140–230 |
| Comp. Ex. 4 | L | IV | o | x | 130–240 |
| Comp. Ex. 5 | M | IV | x | o | None |

As is apparent from the foregoing results, developers of respective Examples exhibited good smear resistance and high heat resistance. Furthermore, as the wax component functions as releaser, a non-offset region with no problem for practical purposes can be obtained. The incorporation of polyolefin wax resulted in a 10° to 20° C. increase in non-offset region.

In contrast, developers of Comparative Examples could not satisfy both requirements of smear resistance and heat resistance at same time.

What is claimed is:

1. A toner for electrophotography comprising:

(a) a styrene-acrylic polymer resin;

(b) a colorant; and (c) a Fischer-Tropsch wax having average molecular weight not less than 1,000.

2. The toner as claimed in claim 1, the amount of said Fischer-Tropsch wax is in the range between 1 and 10 parts by weight on the basis of 100 parts by weight of the resin.

3. The toner as claimed in claim 2, wherein a solidifying point of said Fischer-Tropsch wax is not less then 100° C.

4. The toner as claimed in claim 1 which further comprises a polyolefin wax.

5. The toner as claimed in claim 4, the total amount of said Fischer-Tropsch wax and polyolefin wax is in the range between 2 and 10 parts by weight on the basis of 100 parts by weight of the resin.

6. The toner as claimed in claim 4, the amount of said polyolefin wax is in the range between 50 and 200 percent by weight on the basis of the Fischer-Tropsch wax.

7. The toner as claimed in claim 1 wherein said styrene-acrylic polymer comprises styrene and at least one monomer selected from the group consisting of n-butyl acrylate and methyl methacrylate.

8. The toner as claimed in claim 1 which further comprises a fluidizing agent.

9. The toner as claimed in claim 8, the amount of said fluidizing agent is not more than 2 parts by weight on the basis of 100 parts by weight of the resin.

10. The toner as claimed in claim 1 which further comprises a charge controlling material.

11. The toner as claimed in claim 10 wherein said charge controlling material includes at least one member selected from the group consisting of nigrosine dyes, metal-containing dyes, quaternary ammonium salts and nitrogen-containing polymers.

12. The toner as claimed in claim 10, the amount of said charge controlling material is not more than 8 parts by weight on the basis of 100 parts by weight of a binder resin.

13. The toner as claimed in claim 1, the average particle size of the toner is in the range between 3 and 20 μm.

14. The toner as claimed in claim 1 which further comprises a carbon black as a colorant.

15. The toner as claimed in claim 14, the amount of said colorant is in the range between 1 and 20 parts by weight on the basis of 100 parts by weight of a binder resin.

16. The toner as claimed in claim 1, the solidifying point of said Fischer-Tropsch wax is not less than 100° C.

17. The toner as claimed in claim 1, wherein the average molecular weight of said Fischer-Tropsch wax is in the range between 1,000 and 2,000.

18. The toner as claimed in claim 17, wherein the average molecular weight of said Fischer-Tropsch wax is in the range between 1,000 and 1,300.

19. The toner as claimed in claim 18, wherein the average molecular weight of said Fischer-Tropsch wax is in the range between 1,200 and 1,300.

20. The toner as claimed in claim 19, wherein the average molecular weight of said Fischer-Tropsch wax is in the range between 1,200 and 2,000.

21. A developer for electrophotography comprising:

(a) a toner comprising a styrene-acrylic copolymer resin, a colorant and a Fischer-Tropsch wax having average molecular weight not less than 1000; and (b) a carrier selected from the group consisting of a binder type carrier, which comprises resin and magnetic powder dispersed in the resin, and a resin-coated carrier, which comprises magnetic core material and resin coating the core material.

22. The developer as claimed in claim 21, an amount of said Fischer-Tropsch wax is in the range between 1 and 10 parts by weight on the basis of 100 parts by weight of a binder resin for toner.

23. The developer as claimed in claim 22, wherein a solidifying point of said Fischer-Tropsch wax is not less than 100° C.

24. The developer as claimed in claim 21, wherein said toner further comprises a polyolefin wax.

25. The developer as claimed in claim 24, wherein the total amount of said Fischer-Tropsch wax and polyolefin wax is in the range between 3 and 10 pans by weight on the basis of 100 pans of weight of the binder resin.

26. The developer as claimed in claim 21, wherein said toner further comprises a fluidizing agent.

27. The developer as claimed in claim 21, the solidifying point of said Fischer-Tropsch wax is not less than 100° C.

28. The developer as claimed in claim 21, wherein the average molecular weight of said Fischer-Tropsch wax is in the range between 1,000 and 2,000.

29. The developer as claimed in claim 28, wherein the average molecular weight of said Fischer-Tropsch wax is in the range between 1,200 and 2,000.

30. The developer as claimed in claim 28, wherein the average molecular weight of said Fischer-Tropsch wax is in the range between 1,000 and 1,300.

31. The developer as claimed in claim 30, wherein the average molecular weight of said Fischer-Tropsch wax is in the range between 1,200 and 1,300.

* * * * *